US006394427B1

(12) United States Patent
Guetersloh et al.

(10) Patent No.: US 6,394,427 B1
(45) Date of Patent: May 28, 2002

(54) DRAINLESS HUMIDIFIER WITH WATER LEVEL SENSING

(75) Inventors: Timothy L. Guetersloh, Deerfield; Robert C. LaMuro, Fort Atkinson; Eric L. Brodsky, Madison; Roger M. Pasch, Sun Prairie, all of WI (US)

(73) Assignee: Research Products Corp., Madison, WI (US)

( * ) Notice: Subject to any disclaimer, the term of this patent is extended or adjusted under 35 U.S.C. 154(b) by 0 days.

(21) Appl. No.: 09/660,596

(22) Filed: Sep. 13, 2000

(51) Int. Cl.[7] ..... B01F 3/04

(52) U.S. Cl. ..... 261/70; 261/99; 261/106; 261/107

(58) Field of Search ..... 261/70, 97, 98, 261/99, 103, 104, 106, 107, DIG. 46

(56) References Cited

U.S. PATENT DOCUMENTS

| | | | | | |
|---|---|---|---|---|---|
| 2,326,089 | A | * | 8/1943 | Wittman | 261/70 |
| 3,005,486 | A | * | 10/1961 | Donnell | 261/70 |
| 3,105,860 | A | * | 10/1963 | Dunn | 261/70 |
| 3,294,080 | A | * | 12/1966 | Adams | 261/70 |
| 5,252,260 | A | | 10/1993 | Schuman | |
| 5,374,381 | A | * | 12/1994 | Schuld et al. | 261/107 |
| 6,000,684 | A | * | 12/1999 | Pasch et al. | 261/107 |
| 6,110,564 | A | * | 8/2000 | Pontius | 261/107 |
| 6,168,139 | B1 | * | 1/2001 | Kennedy et al. | 261/107 |

FOREIGN PATENT DOCUMENTS

| | | | | |
|---|---|---|---|---|
| GB | 132439 | * | 9/1919 | 261/106 |
| JP | 57-188945 | * | 11/1982 | 261/107 |

* cited by examiner

*Primary Examiner*—C. Scott Bushey
(74) *Attorney, Agent, or Firm*—Andrus, Sceales, Starke & Sawall, LLP

(57) ABSTRACT

A housing is permanently connected to a water supply of a building and includes an evaporative water panel allowing water to flow downwardly and wick upwardly. A circulating device is provided for directing air from the building through the water panel. A reservoir is positioned in the housing for supporting the water panel and holding excess water deposited from the water panel. A water distributor is supplied for moving water from the water supply to a top of the water panel. A water control arrangement is responsive to the water level therein for automatically controlling the flow of water to the water panel to provide a desired humidity level in the building.

15 Claims, 9 Drawing Sheets

10
2
12
20
22
24
14
16
18
46
47
32
48
62
2
BUILDING WATER SUPPLY
20
28
26

10
12
24
14
16
18
53
51
32
54
26

DRAINLESS HUMIDIFIER WITH WATER LEVEL SENSING

FIELD OF THE INVENTION

This invention relates generally to humidifiers, and more particularly, control of evaporation in a humidifier used in conjunction with a furnace or heating system and connected to the plumbing system of a building. Humidifiers of this type typically use an air circulation arrangement to move air across a water-soaked evaporative pad. The humidifier is associated with the furnace or heating system so that the humidifier moist air can be combined with the warm, generally dry, heated air and distributed through a building.

BACKGROUND OF THE INVENTION

Humidifiers generally characterized by a housing having an evaporative water panel constructed of slit and expanded non-wicking paper, removably disposed in a reservoir at the bottom thereof. The housing also has a mechanical float valve which is connected to a water supply of a heated building. A water feed tube is connected to the mechanical float valve for supplying water to a distributor from which water flows by gravity down through the water panel. Air is forced through the water panel and the air evaporates water on the water panel, so that humidified air is delivered to the building.

Such humidifiers typically employ a device such as a humidistat, for establishing predetermined humidity set point and reading humidity levels in the building. The humidistat is connected in a circuit with a pump and operates, in the presence of low humidity, to automatically deliver water from a lower reservoir to the top of the water panel and downwardly therethrough. Some of the water evaporates from the water panel and is air blown to provide humidity to the building. The remainder of the water collects in the reservoir at the bottom of the water panel. As the reservoir level drops due to loss of evaporated water, the float valve opens to allow water in from supply and maintains reservoir level. The pump recirculates water from the reservoir over the non-wicking water panel. This cycle continues as long as the humidistat reads low humidity. Once the humidity set point is reached, the circuit is opened and water flow ceases.

There also exist drum-type humidifiers wherein a motor and gear system is used to rotate a drum in a reservoir of standing water.

While such designs generally provide the desired humidification, there arises problems in the cost, noise, maintenance, electrical power needs and reliability associated therewith. Another problem with these designs is that the reservoir remains filled no matter if humidity is needed or not. As a result, there is a possibility of undesirable bacteria, algae, fungus, mold, etc.

Accordingly, it is desirable to provide a humidifier which is responsive to the changing water level in the reservoir. It is also desirable to provide a humidifier which is more economical in cost, runs more quietly, requires less maintenance and lessens the electrical power needs.

SUMMARY OF THE INVENTION

It is one object of the present invention to provide a humidifier employing a float switch which responds to the water level in the reservoir.

It is also an object of the present invention to provide a humidifier which employs a wicking-type evaporative water panel.

It is a further object of the present invention to provide a humidifier which allows for complete evaporation of water in the reservoir.

It is an additional object of the present invention to provide a humidifier which operates normally without the need for a drain.

Still another object of the present invention is to provide a humidifier which is easier to manufacture and maintain and which is safer to operate.

In one aspect of the invention, a housing is permanently connected to a water supply of a building and includes an evaporative water panel allowing water to flow downwardly and wick upwardly. A circulation device is provided for directing air from the building to the water panel. A reservoir is positioned in the housing for supporting the water panel and for holding excess water deposited from the water panel. A water distributor is provided for moving the water from the water supply to the top of the water panel. A water control arrangement is responsive to the water level within the reservoir for automatically controlling the flow of water to the water panel to provide a desired humidity level in the building. The water panel is comprised of a multi-layer, slit and expanded, wicking paper. In the preferred embodiment, the air circulating device includes a blower associated with a furnace, or a fan built integrally into the humidifier and the reservoir includes first and second vertical walls connected to a horizontal base wall. The water control arrangement includes a solenoid valve connected to a water level sensor. The water level sensor is preferably comprised of a float switch having a float member provided with a magnet therein, and a reed switch connected to the solenoid valve. The float member and magnet are positioned above the horizontal base wall of the reservoir, and the reed switch is aligned with the magnet and positioned below the reservoir, isolated from any water contact therewith. In the preferred embodiment, the reservoir includes a tubular chamber and the float member is a ball-shaped float.

The invention also contemplates various other methods for movably mounting the float member. In one embodiment the reservoir includes a post having one end of the hinge slidably attached thereto and another end of the hinge attached to the float member. In another alternative embodiment, the reservoir includes a post having one end of a solid folding hinge attached thereto and the other end of the solid folding hinge attached to the float member. In yet another alternative embodiment, the reservoir includes a set of posts upon which the float member is slidably mounted. In still another alternative embodiment, the reservoir includes a post provided with a pivoted edge having one end of a float arm pivotally attached. thereto and another end of the float arm attached to the float member. In still another alternative embodiment, the reservoir includes a horizontal ledge having one end of a flexible hinge attached thereto and another end of the flexible hinge attached to the float member.

The water distributor is a tube extending from the solenoid valve to an outlet nozzle and a weir-type distributor trough which is positioned over the water panel. The water distributor may also take the form of a feed tube extending from the solenoid valve to an outlet manifold positioned over the water panel. An overflow tube is molded directly to the side of the reservoir for receiving any water which overflows the reservoir. The humidifier typically includes a humidistat for establishing a desired humidity level.

In another aspect of the invention, the humidifier has a device for controlling the flow of water to an evaporative water panel positioned in a reservoir and allows water to flow downwardly and wick upwardly. The humidifier also has a humidistat for establishing a desired humidity level and an operative circulating means for directing air through the water panel. The humidifier includes a water level sensor which is associated with the reservoir and which is responsive to the water level therein to alternatively open and close a circuit to control the flow of water to the water panel. With this construction, when the water level in the reservoir is low, the circuit is closed to deliver water to the water panel such that some water evaporates from the water panel and the remainder collects in the reservoir. A rising water level in the reservoir causes the sensor to open the circuit, stopping water delivery, humidification continuing as water wicks upwardly through the water panel. The falling water level in the reservoir causes the sensor to close the circuit, delivering further water to the panel, the reservoir eventually drying out once the desired humidity is reached. The humidistat forces the circuit open when the desired humidity level is reached so as to prevent the water cycling on and off indefinitely. Stoppage of the circulating means will have the same effect.

Various other features, objects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
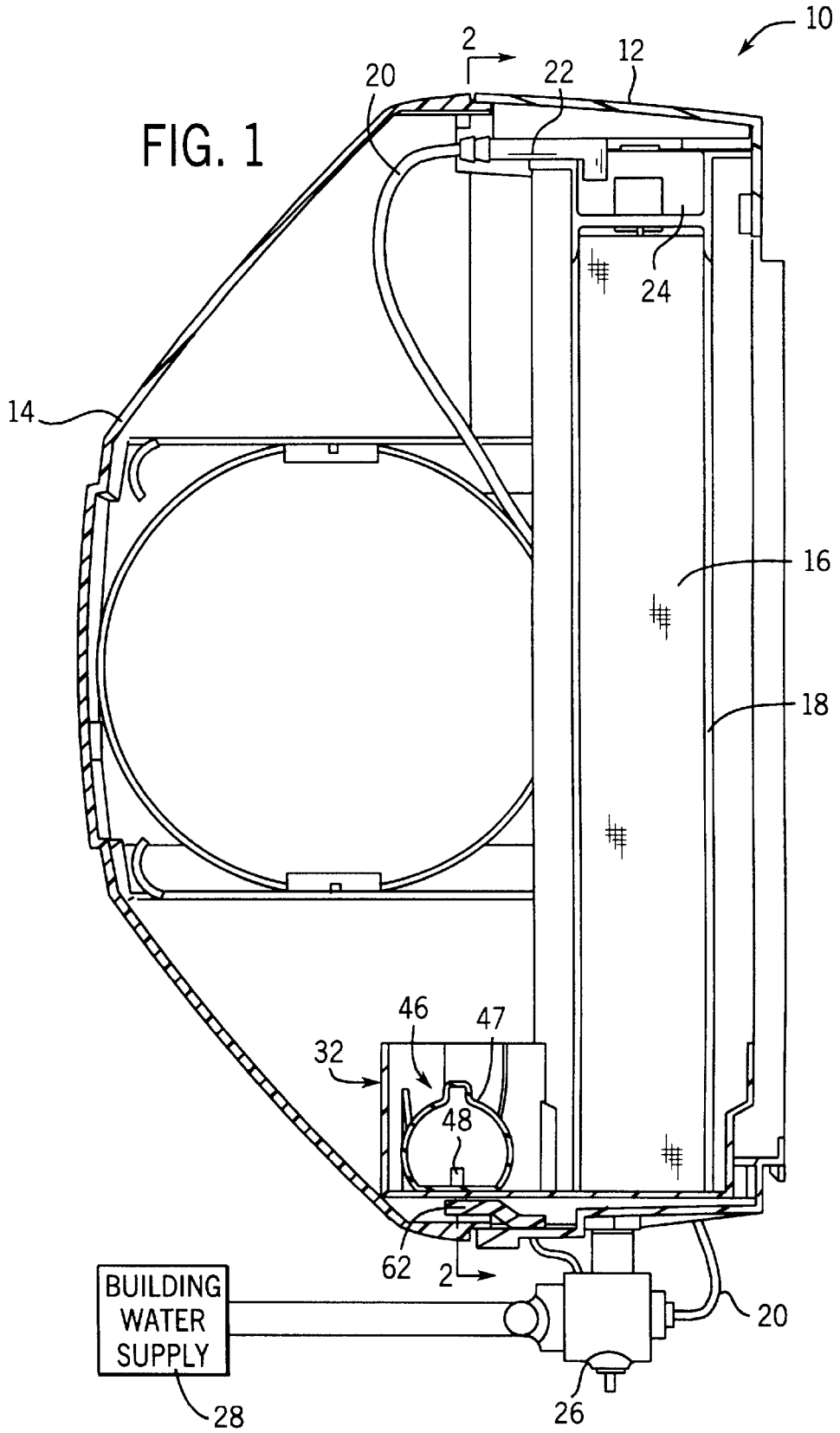
FIG. 1 is a side cross sectional view of a humidifier embodying the present invention.
Figure 1A:
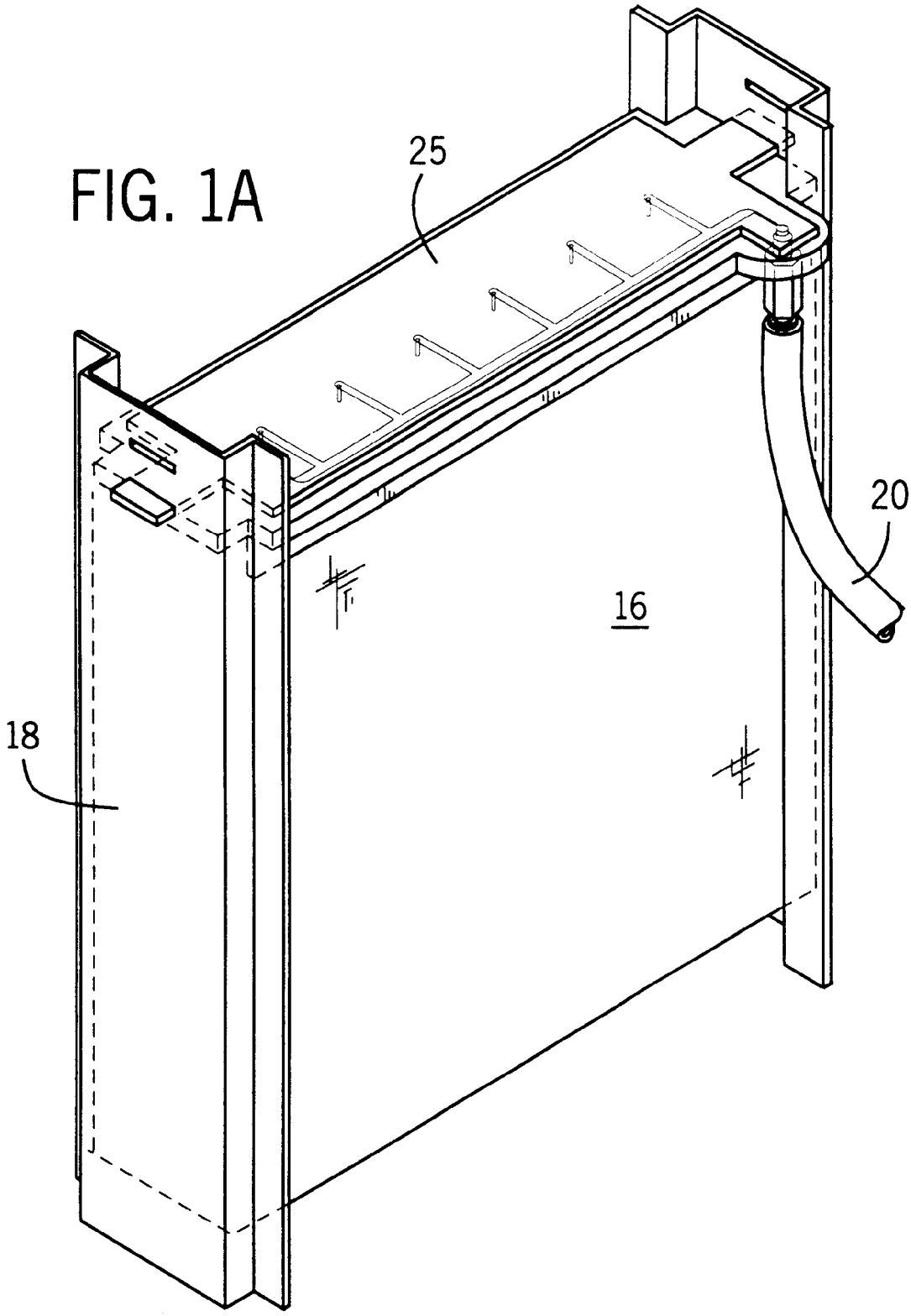
FIG. 1A is a view of an alternative distributor in the form of an outlet manifold.

As seen in FIG. 1, a humidifier 10 embodying the present invention includes a base portion 12 and cover 14 which define a housing that is mounted on a portion of the furnace or on a wall or ceiling. Base portion 12 includes an evaporative water panel 16 preferably formed of a slit and expanded construction of wicking paper mounted in a framework or scale control 18. Base portion 12 also includes a water feed tube 20 having one end which supplies water to a nozzle 22 and distributor 24 for the water panel 16. Another end of feed tube 20 is joined to a solenoid valve 26 which controls the flow of water through the feed tube 20. Solenoid valve 26 is, in turn, permanently connected to the plumbing or water supply 28 of a building. As depicted in FIG. 1A, distributor 24 may also take the form of a manifold 25 for conducting water therethrough. The humidifier 10 also includes air circulation means such as a furnace blower fan 30 (FIG. 4) for directing air through the wetted water panel 16. A humidistat 31 (FIG. 4) is commonly used to set a desired humidity set point.

Figure 2:
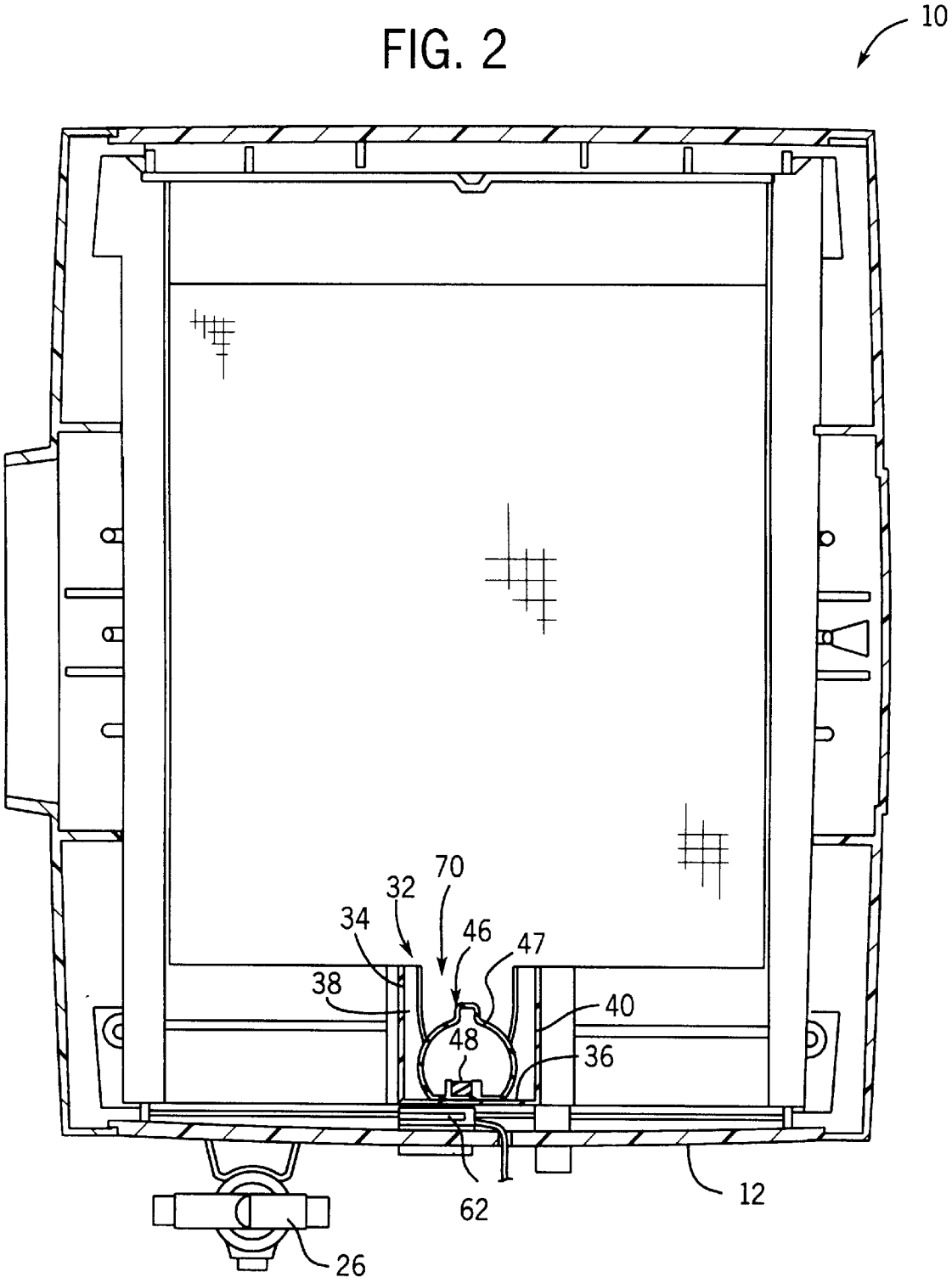
FIG. 2 is a fragmentary view of a reservoir and float switch arrangement of the humidifier of FIG. 1 with a low water level as taken on line 2—2 of FIG. 1.
Figure 3:
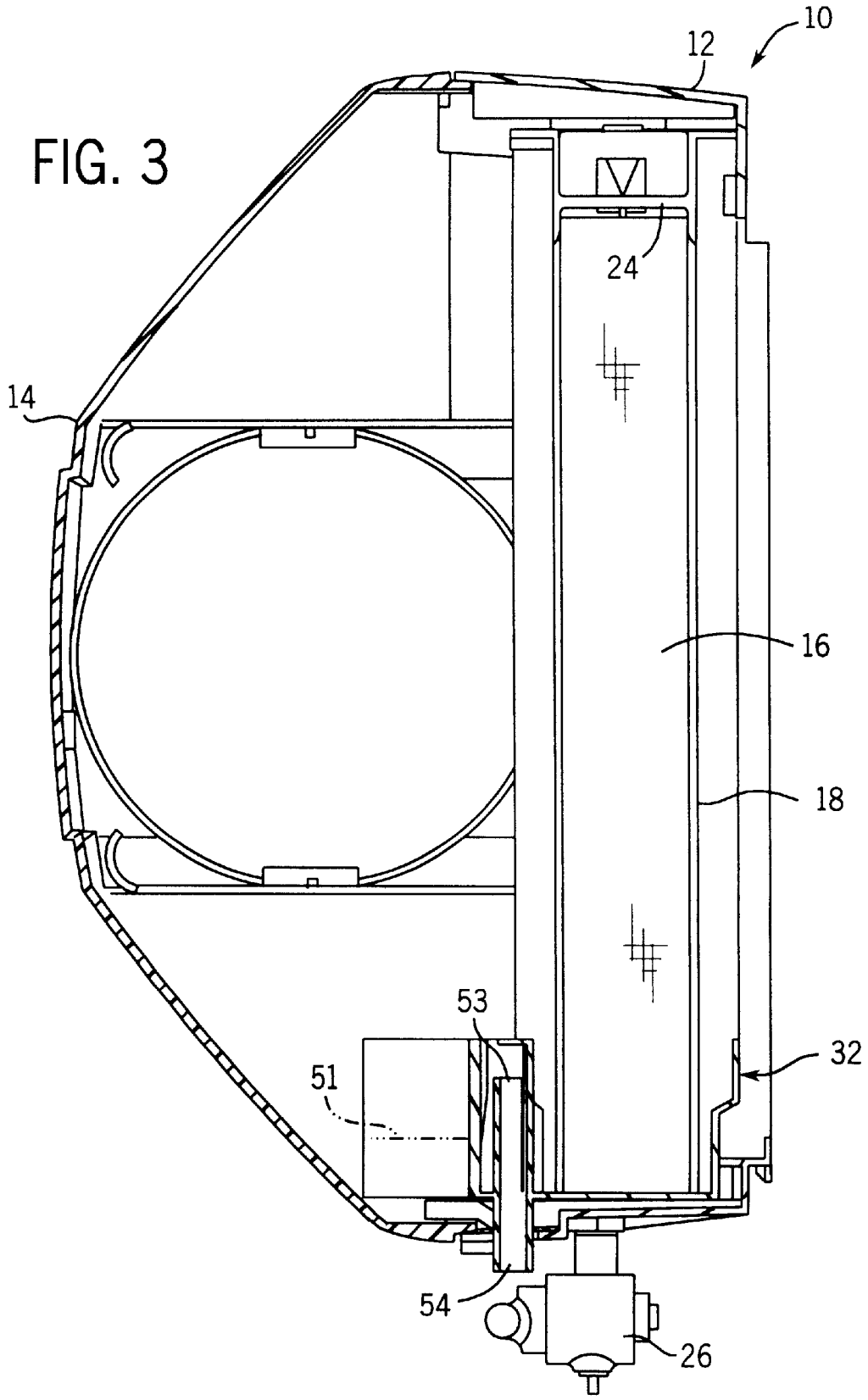
FIG. 3 is a cross sectional view showing an overflow tube molded directly to the reservoir.

In accordance with the invention, part of the scale control 18 is provided with either an integral or separate small reservoir 32 for holding excess water supplied to the water panel 16. As seen best in the preferred embodiment of FIGS. 2, reservoir 32 includes a tubular chamber 34 having a main well formed by a base wall 36 and first and second vertical walls 38,40. A water level sensing float member 46 takes the form of a ball float 47 having a magnet 48 mounted internally within and supported on base wall 36 when the water level is low. Depending on the water level in the reservoir well, the ball 47 will be enabled to move up or down in chamber 34. Referring to FIG. 3, molded to the side of the reservoir 32 is an overflow tube 54 for receiving any water which overflows the reservoir 32. Reference numeral 51 indicates the normal water level in the reservoir 32. If solenoid valve 26 fails and the water level goes too high, water drains over the lip 53 of overflow tube 54 and into a drain before it floods over the top of reservoir 32. Attached to the base portion 12 beneath base wall 36 and between vertical walls 38,40 is a reed switch 62 which is suitably electrically connected to the solenoid valve 26. As seen in FIG. 2, the reed switch 62 is aligned beneath the magnet 48 in ball float 47. As will be understood more fully hereafter, the magnet 48 in the ball float member 47 cooperates with the reed switch 62 to define a float switch 70. With water in the reservoir well at the low level, the float switch 70 has a closed position which will allow the solenoid valve 26 to remain open. With water in the reservoir well at a high level, the float switch 70 has an open position which will close the solenoid valve 26.

Figure 4:
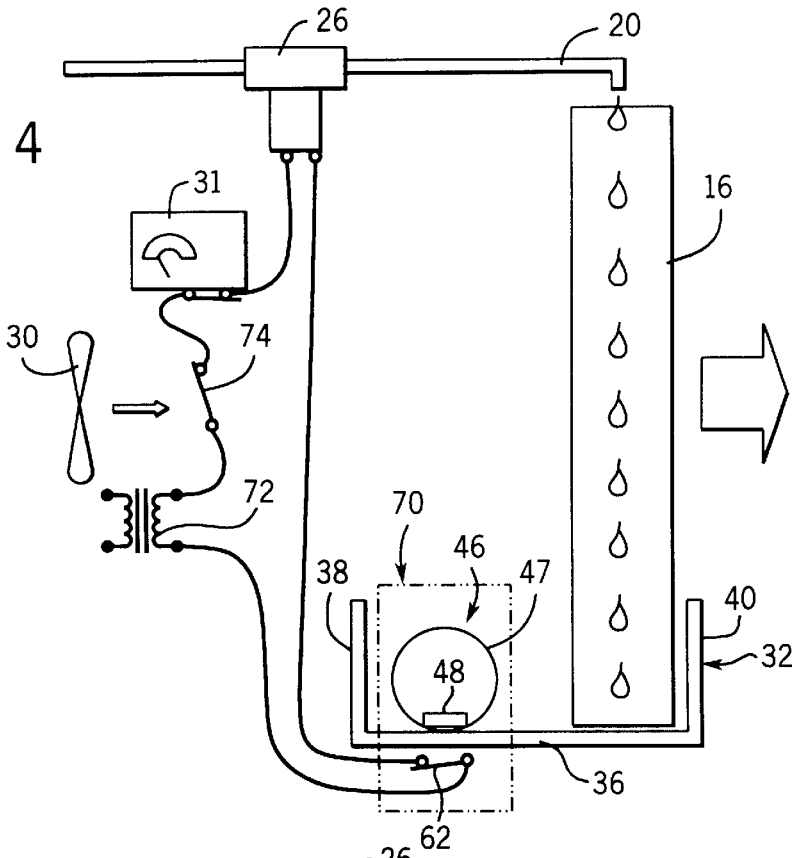
FIG. 4 is a diagrammatic view showing a typical start-up mode for the humidifier of FIG. 1.
Figure 5:
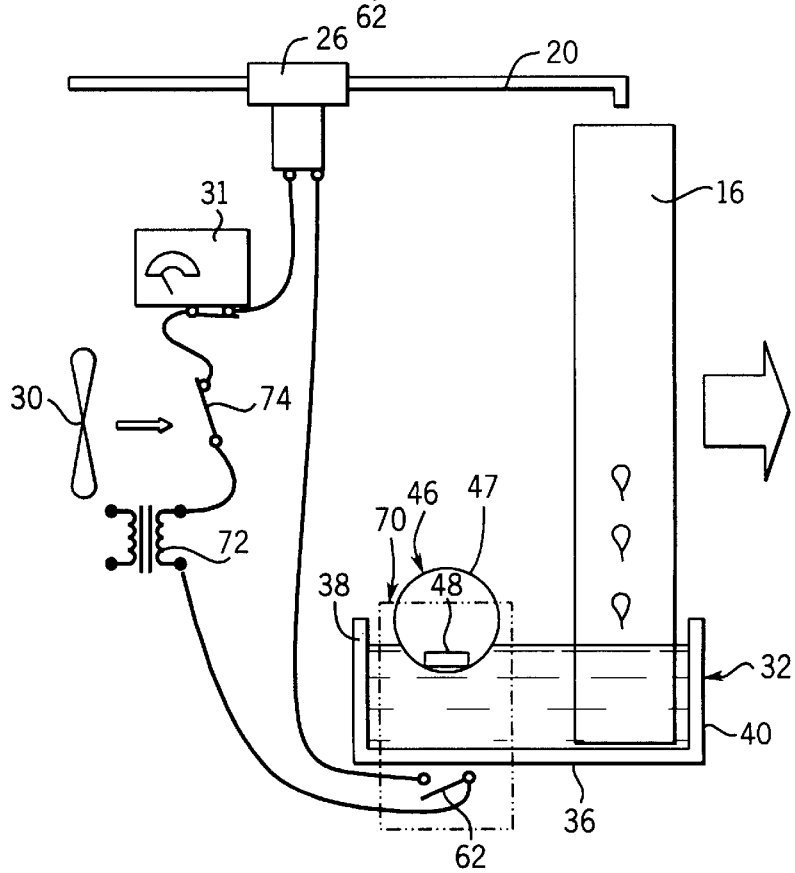
FIGS. 5 and 6 are diagrammatic views depicting a humidification cycle for the humidifier of FIG. 1.
Figure 6:
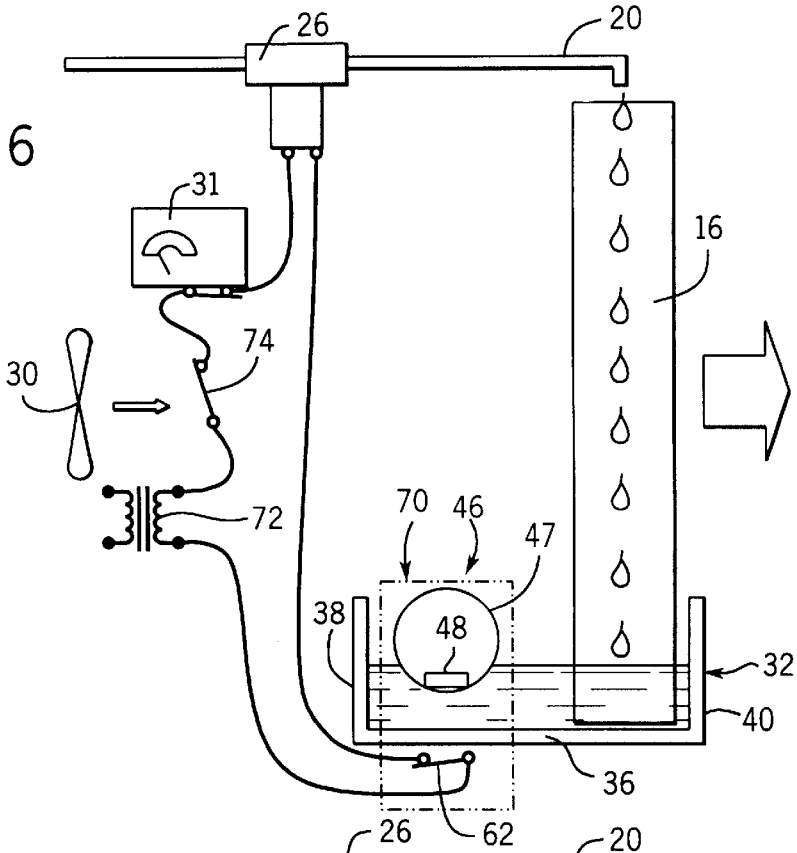
Figure 7:
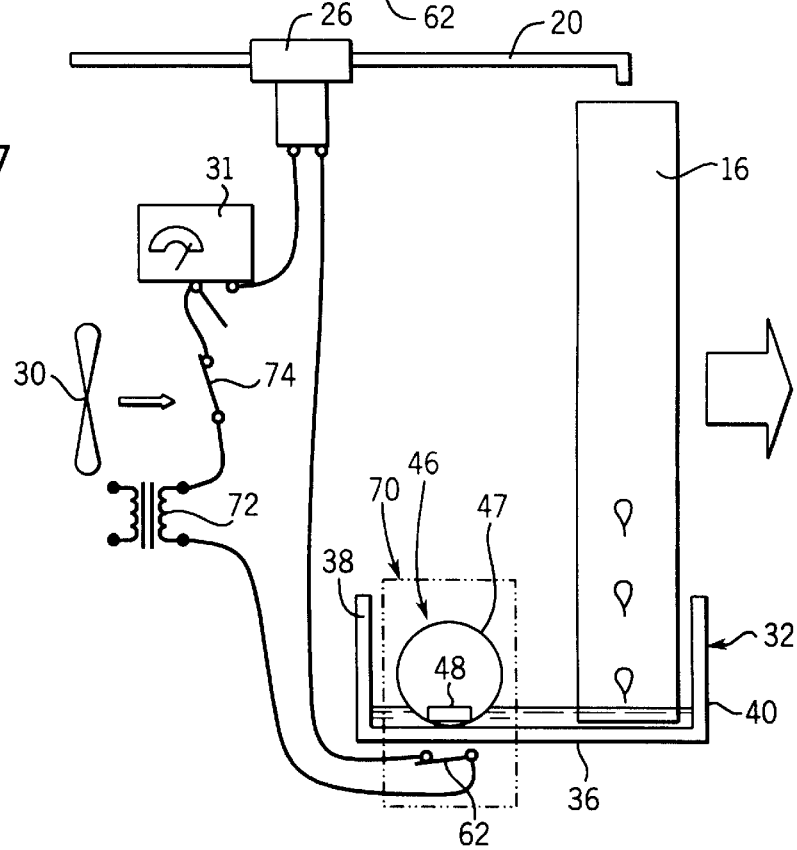
FIGS. 7 and 8 are diagrammatic views depicting a dry-down mode for the humidifier of FIG. 1.
Figure 8:
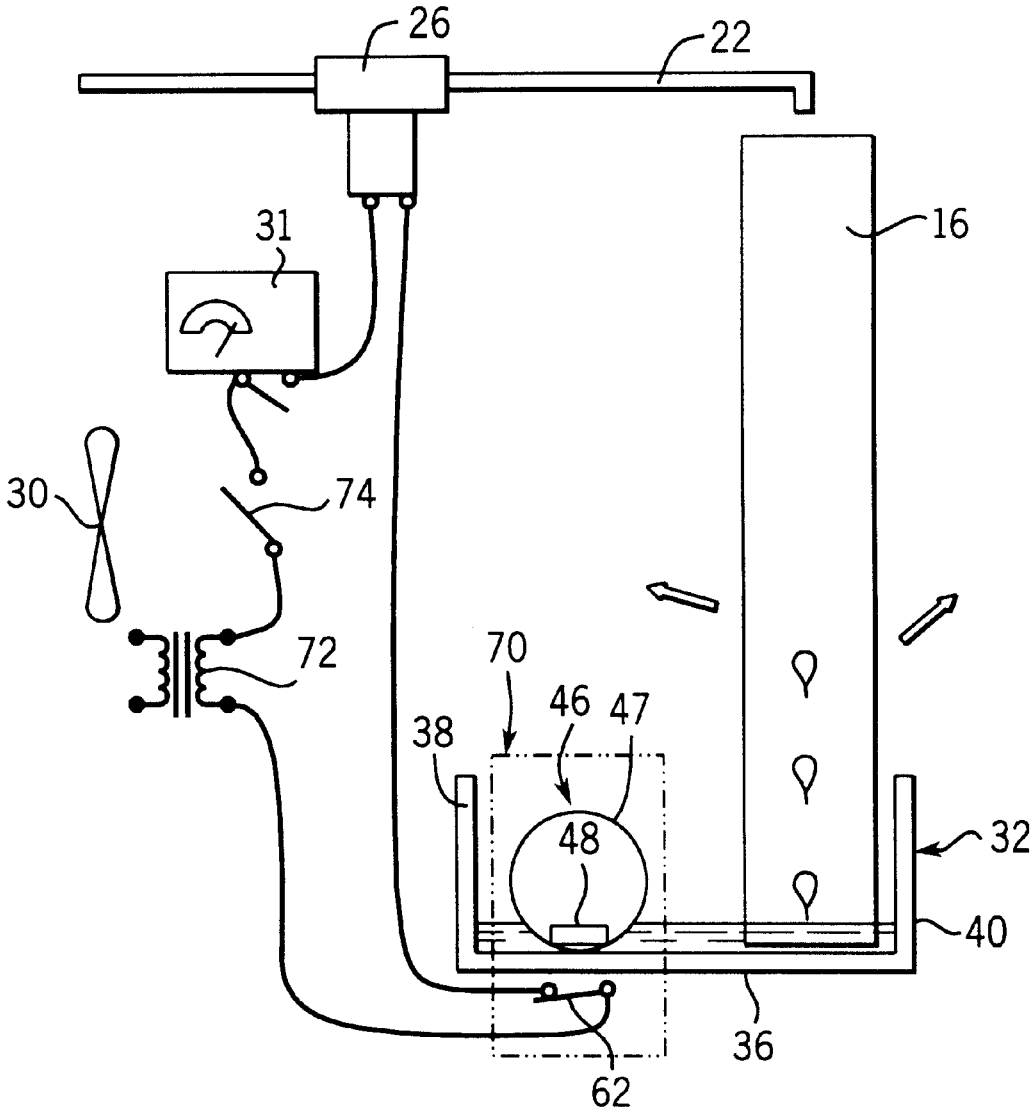

Referring now to FIGS. 4–8, the operation of the humidifier 10 will now be described. It can be seen that a transformer 72, a furnace sensor 74, solenoid valve 26, humidistat 31, and float switch 70 are serially connected in a circuit and are responsive to the on/off condition of the motor-driven furnace fan 30. When furnace fan 30 is "on", sensor 74 closes, humidistat 31 senses low humidity when the water level in the reservoir 32 is low, and magnet 48 in float member 46 holds reed switch 62 closed, so that the float switch 70 is closed (FIG. 4). A circuit is completed to the solenoid valve 26 which opens and supplies water to the distributor 24 at the top of the humidifier 10. Water drains from the distributor 24 and runs downwardly through the water panel 16. Some water evaporates from the water panel 16 to provide humidity to the building. The remainder of the water collects in the reservoir 32 at the bottom of water panel 16. As the water level rises (FIG. 5), the float member 46 lifts the magnet 48 away from the reed switch 62 to a point where the reed switch opens a circuit and causes the solenoid valve 26 to close. Humidification continues as water now wicks upwardly (FIG. 5) from reservoir 32 into the water panel 16. This action is made possible by purposely constructing the water panel 16 with the slit and expanded wicking paper. Eventually, the water level drops (FIG. 6) and the magnet 48 again closes the circuit to solenoid valve 26, so that more water enters the humidifier 10. This cycle continues (FIG. 7) as long as the furnace fan 30 runs and the humidistat 31 reads low humidity. When the humidity set point has been satisfied, the reservoir 32 will dry out (FIG. 8) because water continues to wick into the water panel 16 and evaporates while the humidistat 31 holds the circuit open and prevents more water from entering the humidifier.

It should be appreciated that the humidifier 10 of the present invention provides a magnetic level sensing device in which the float member 46 and magnet 48 are placed in a separate assembly from reed switch 62. This feature allows for easy replacement of the water panel 16 without having to disconnect any wires. It also maintains the electrical switch outside the water containing reservoir 32 which is safer and easier to manufacture because waterproofing is not needed. By downsizing the reservoir 32 and eliminating the pump of prior humidifiers. there is a reduction in cost, noise, and electrical power needs. Because the present invention is designed to dry out the reservoir 32, undesirable biological growths are limited. Whereas the prior art relied on non-wicking paper for allowing downward migration of moisture, the present invention by virtue of the wicking paper also enables upward migration of moisture which aids the evaporation.

Figure 9:
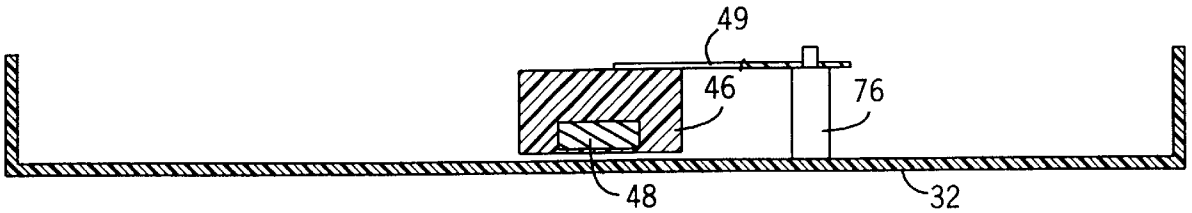
FIGS. 9–13 are alternative embodiments of various arrangements for movably mounting a portion of the float switch.
Figure 10:
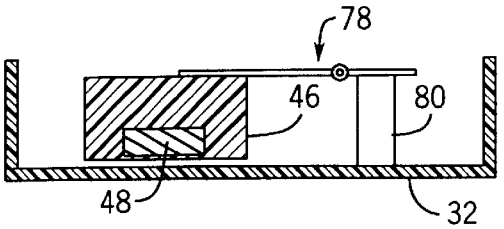
Figure 11:
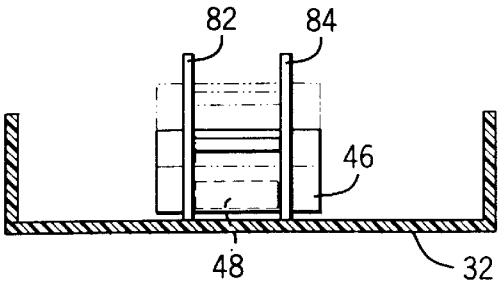
Figure 12:
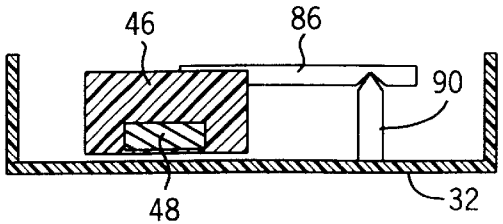

It should also be noted that while in the preferred embodiment the water level sensor has float member 46 in the form of a ball with a magnet 48 which floats in a tubular channel of the reservoir 32, there are other arrangements contemplated to perform the same result. In the alternative embodiment in FIGS. 9, a flexible hinge 49 has one end connected to a float member 46 and another end having a mechanical pivot point, such as that of a stepped vertical shaft 76 in a hole formed in the flexible hinge 49. In FIG. 10, a solid articulating or folding hinge 78 has one end connected to the float member 46 and another end connected to a vertical post 80. In FIG. 11, float member 46 is mounted for sliding up and down movement on a pair of vertical posts 82,84. In FIG. 12, a rocker arm 86 has one end connected to float member 46 and another end pivotably mounted on a pointed edge of a vertical post 90.

Figure 13:
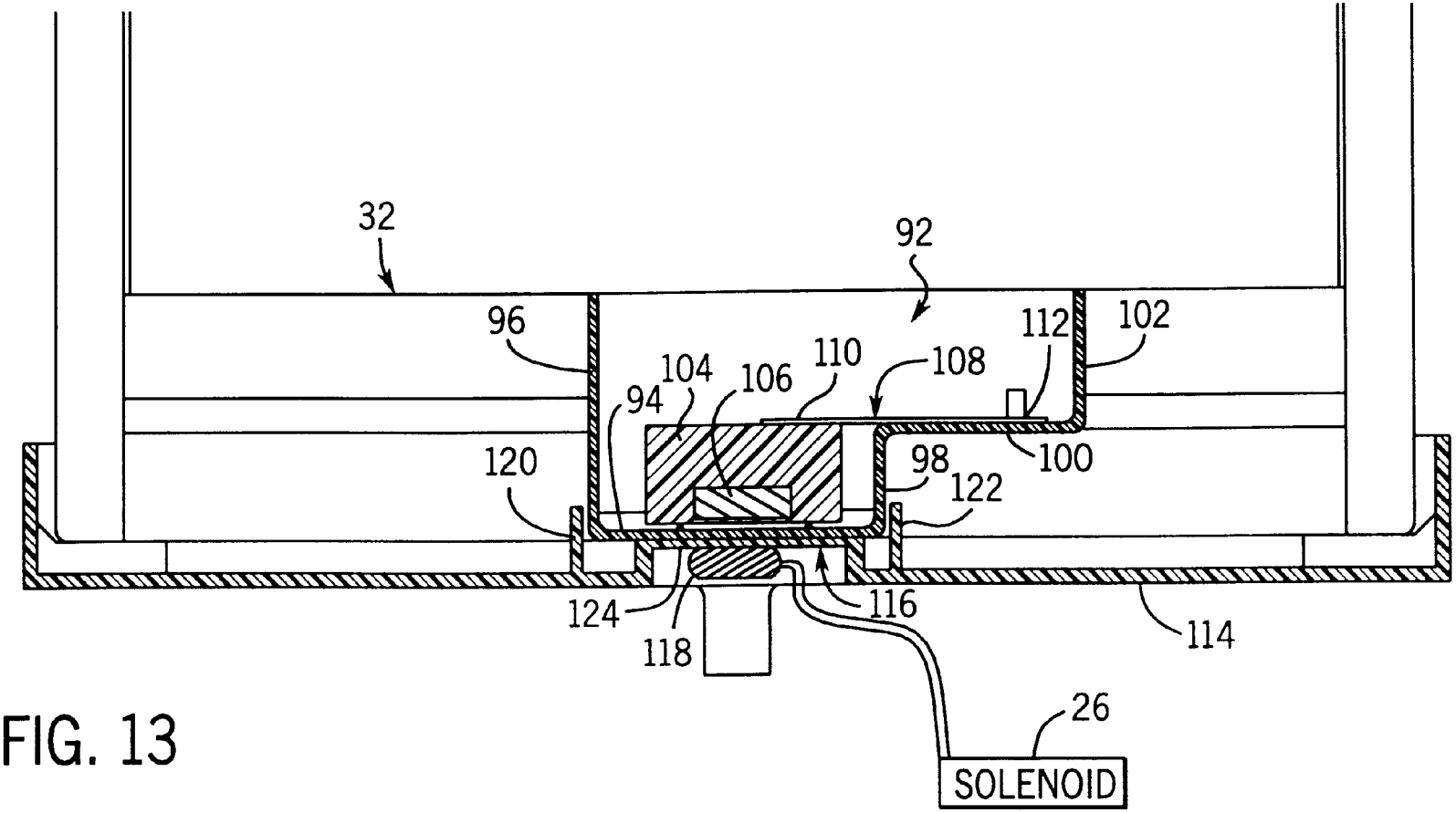

In FIG. 13, a forward portion of the reservoir 32 includes a stepped compartment 92 having a main well formed by a base wall 94 and first and second vertical walls 96,98. The shorter vertical wall 98 is formed with an outwardly projecting horizontal ledge 100 which turns into a third vertical wall 102. A water level sensing float member 104 having a magnet 106 mounted internally within is supported on the base wall 94 when thew water level is low. A flexible hinge 108 has one end 110 secured to the top of float member 104 and has another end 112 anchored to the ledge 100. A bottom wall 114 has a raised boss 116 creating an interior space for a reed switch 118. Bottom wall 114 is also formed with a set of upright ribs 120,122 which function to locate vertical walls 96,98 therebetween with the base wall 94 of stepped compartment 92 resting upon an upper horizontal wall 124 of the boss 116. The ribs 120,122 provide alignment of the reservoir 32 and its float member 104, and magnet 106 with the reed switch 118.

It is also noted that other means may be used to sense water, such as with electrical conductivity sensors, or optical, sound wave or weight sensing arrangements.

It should be mentioned that the reservoir 32 can be provided, if desired, with a downwardly depending conduit used to lead water away to a drain. This is a desirable safety feature which is useful should the solenoid valve 26 become jammed open or otherwise held open due to an electrical failure. However, in the intended operation, all water supplies would be evaporated and the drain would not be used.

While the invention has been described with reference to a preferred embodiment, those skilled in the art will appreciate that certain substitutions, alterations and omissions may be made without departing from the spirit thereof. For example, in humidifiers having an internal fan, the furnace sensor 74 would not be used, and the fan would be controlled via a relay added to the circuit.

We claim:

1. A humidifier comprising:

a housing permanently connected to a water supply of a building and including an evaporative water panel allowing water to flow downwardly and wick upwardly;

circulating means for directing air from the building through the water panel;

a reservoir positioned in the housing for supporting the water panel and holding excess water deposited from the water panel;

a water distributor for moving the water from the water supply to a top of the water panel; and water control means responsive to the water level therein for automatically controlling the flow of water to the water panel to provide a desired humidity level in the building, wherein the reservoir includes first and second vertical walls connected to a horizontal base wall, wherein the water control means includes a solenoid valve connected to a water level sensor, and wherein the water level sensor is comprised of a float switch having a float member provided with a magnet therein and a reed switch connected to the solenoid valve, the float member and magnet being positioned above the horizontal base wall of the reservoir, and the reed switch being aligned with the magnet and positioned below the reservoir isolated from any water contact therewith.

2. The humidifier of claim 1, wherein the water panel is comprised of multi-layer, slit and expanded, wicking paper.

3. The humidifier of claim 1, wherein the circulating means includes a blower associated with a furnace.

4. The humidifier of claim 1, wherein the circulating means is a fan built integrally into the humidifier.

5. The humidifier of claim 1, wherein the float member is movable relative to the reservoir mounted thereto.

6. The humidifier of claim 1, wherein the reservoir includes a tubular chamber and the float member is a ball-shaped float.

7. The humidifier of claim 1, wherein the reservoir includes a support member having one end of a flexible hinge attached thereto and another end of the flexible hinge attached to the float member.

8. The humidifier of claim 1, wherein the reservoir includes a post having one end of a solid folding hinge attached thereto and the other end of the solid folding hinge attached to the float member.

9. The humidifier of claim 1, wherein the reservoir includes at least one post upon which the float member is slidably constrained.

10. The humidifier of claim 1, wherein the reservoir includes a post provided with a pivoted edge having one end of a float arm pivotably attached thereto and another end of the float arm attached to the float member.

11. The humidifier of claim 1, wherein the water distributor is a feed tube extending from the solenoid valve to a weir-type distributor.

12. The humidifier of claim 1, wherein the water distributor is a feed tube extending from the solenoid valve to an outlet nozzle positioned over the water panel.

13. The humidifier of claim 1, wherein the water distributor is a feed tube extending from the solenoid valve to an outlet manifold positioned over the water panel.

14. The humidifier of claim 1, including an overflow tube attached to the side of the reservoir for receiving any water which overflows the reservoir.

15. The humidifier of claim 1, including a humidistat for establishing a desired humidity level.

* * * * *